US005129515A

United States Patent [19]

Rutt et al.

[11] Patent Number: 5,129,515

[45] Date of Patent: Jul. 14, 1992

[54] PRESSURE SENSITIVE TAPE DISPENSER

[76] Inventors: David M. Rutt, Rte. 2, Box 587, Keswick, Va. 22947; Steven V. Dunavant, Rte. 1, Box 165 A, Barboursville, Va. 22923

[21] Appl. No.: 703,365

[22] Filed: May 21, 1991

[51] Int. Cl.[5] ..... B65D 85/672

[52] U.S. Cl. ..... 206/394; 206/411

[58] Field of Search ..... 206/391-394, 206/411; 242/55.3; 312/39, 41

[56] References Cited

U.S. PATENT DOCUMENTS

| | | | |
|---|---|---|---|
| 296,484 | 4/1884 | Tate . | |
| 556,068 | 3/1896 | Schloss . | |
| 757,844 | 4/1904 | Scott . | |
| 907,935 | 12/1908 | Wolslayer . | |
| 985,564 | 2/1911 | Adamson | 242/55.3 |
| 1,174,651 | 3/1916 | Austin . | |
| 1,487,607 | 3/1924 | Rosen | 242/55.3 |
| 2,015,283 | 9/1935 | Pashley et al. | 206/394 |
| 2,462,816 | 2/1949 | Scher, Jr. . | |
| 2,463,037 | 3/1949 | Holm . | |
| 3,603,519 | 9/1971 | Brown et al. | 312/39 |
| 3,969,007 | 7/1976 | Lowry | 206/387 |
| 4,252,258 | 2/1981 | Plummer . | |
| 4,570,794 | 2/1986 | Capitao . | |

FOREIGN PATENT DOCUMENTS

| | | | |
|---|---|---|---|
| 1026447 | 4/1953 | France | 312/39 |
| 2401850 | 4/1979 | France | 206/394 |

*Primary Examiner*—Jimmy G. Foster

*Attorney, Agent, or Firm*—Sheldon H. Parker

[57] ABSTRACT

A novel container is disclosed which can contain rolls of pressure sensitive tape of various widths and which provides for rapid and convenient dispensing of the pressure sensitive tape with the simultaneous separation of a release film from the pressure sensitive tape. The tape dispenser comprises a container a first side wall, a second side wall, a top wall, a bottom wall and a back wall. The top wall is provided with a plurality of parallel grooves. Similarly, the bottom wall is provided with a plurality of parallel grooves. The top wall's parallel groove are positioned so as to correspond in position, to the position of the top wall's parallel grooves. The top wall grooves and the bottom wall grooves are parallel to the first side wall and the second side wall. A plurality of divider walls are mounted in corresponding top and bottom wall grooves. The front wall of the container has a vertical dimension substantially less than the corresponding vertical dimension of the back wall in order to provide a substantial rectangular opening. The front wall is preferably hingedly affixed to the bottom wall, employing, preferably, what is commonly termed a living hinge or a live hinge. The front wall is provided with a lip member which forms an acute angle with the front wall. A retainer or holding means, is located proximate two opposite ends of the lip member, and a bar means is supported in a spaced relationship with said lip member by the holding means. Clamping means releasably secures the front wall to the first and second side walls and enables the front wall to be opened.

7 Claims, 2 Drawing Sheets

PRESSURE SENSITIVE TAPE DISPENSER

BACKGROUND OF THE INVENTION

1. Field of the Invention

This invention relates to a container and dispenser to hold and dispense rolls of pressure sensitive tape.

2. Description of the Prior Art

Pressure sensitive tape is used commonly for automobile pin stripes, as well as art work and drafting. The detailing shops that do the pin striping on cars must carry multiple different widths and colors. If purchased in individual, unprotected rolls, they can easily become damaged or soiled; if purchased in cases, the price increases. There has not been, until the instant disclosure, anyway to neatly protect the rolls and keep the open end easily accessible and protected.

Most of the following patents deal with rolls of non-stick, fabric type material which are loosely wound on rolls. The problems in preventing the free rolling material from coming off the core are substantial in that the material will readily slide off the core.

U.S. Pat. No. 757,844 to Scott discloses a method for holding and cutting ribbon, etc., using a roller on which to place the ribbon and a box to encompass it. The Scott patent is dealing with ribbon or the like rolled on a core.

U.S. Pat. No. 556,068 to Schloss also illustrates a rack and showcase which holds the rolled ribbon and/or fabric.

U.S. Pat. No. 296,484 to Tate, again illustrates an apparatus for holding ribbons wherein dividers are used to separate the rolls which are held on a rod passing through the sides of the box.

U.S. Pat. No. 907,935 to Wolslayer uses a spring like apparatus within the display box to control the rate of unwinding of the ribbon.

The cabinet of U.S. Pat. No. 1,174,651 to Austin also deals with dispensing loosely rolled ribbon, allowing the user to reach under to grip and dispense the ribbon.

U.S. Pat. No. 2,463,037 to Holm discloses a relatively complicated device for dispensing materials which are placed on rolls.

In U.S. Pat. No. 4,570,794 to Capitao, Jr., a container for holding and dispensing rolls of polymeric wrapping film.

U.S. Pat. No. 2,462,816 Schner, Jr. et al, discloses a box for dispensing buttons attached to a roll of paper.

U.S. Pat. No. 4,252,258 to Plummer, discloses a tape dispenser which holds of multiplicity of dissimilar rolls of pressure sensitive tape. Although this patent discloses a device which keeps rolls accessible, the cutting device of the Plummer patent would not be desirable for the pressure sensitive tape as used in body shops. The Plummer patent depends on the adhesive quality of the material to be dispensed to adhere to the shelf 29, thereby holding the tape onto the dispenser.

SUMMARY OF THE INVENTION

The objects of the present invention can be achieved through the use of a novel container which can contain rolls of pressure sensitive tape of various widths and provides for rapid and convenient dispensing of the pressure sensitive tape with the simultaneous separation of a release film from the pressure sensitive tape.

The pressure sensitive tape is mounted on a release film to form a two layer unit. The two layer unit is in the form of a spiral roll of tape. The tape dispenser comprises a container a first side wall, a second side wall, a top wall, a bottom wall and a back wall. The top wall is provided with a plurality of parallel grooves. Similarly, the bottom wall is provided with a plurality of parallel grooves. The top wall's parallel groove are positioned so as to correspond in position, to the position of the top wall's parallel grooves. The top wall grooves and the bottom wall grooves are parallel to the first side wall and the second side wall. A plurality of divider walls, are provided, each of which have a first edge slidably retained in one of the top wall's parallel grooves, and a second edge slidably retained in a groove of the bottom wall. The bottom wall parallel groove containing a particular divider is positioned directly opposite the parallel groove of the top wall. The container also includes a back wall and a a front wall. The front wall has a vertical dimension substantially less than the corresponding vertical dimension of the back wall. Thus, a substantial rectangular opening is provided in the front of the container. The relative dimensions of the opening is not critical, except to the extent that it must be sufficient large to provide convenient access to the rolls of the pressure sensitive tape.

The front wall is preferably hingedly affixed to the container's bottom wall, employing, preferably, what is commonly termed a living hinge or a live hinge. The front wall is provide with a lip member, which forms an acute angle with the front wall. A retainer or holding means, is located proximate two opposite ends of the lip member, and a bar means is supported in a spaced relationship with the lip member by the holding means.

The first side wall and the second side wall have clamping means proximate the partial front wall, thereby releasably securing the partial front wall to the first side wall and the second side wall. The clamping means enable the front wall to be opened, thus providing complete access to the interior of the container. In this manner, used rolls of pressure sensitive tape can be replaced and the slidable divider walls can be removed and/or repositioned so as to alter the spacing provided for a particular roll of pressure sensitive tape. Thus, the container can be readily customized to accommodate rolls of varying widths, as required.

A plurality of rolls of pressure sensitive tape are contained within the container, such that each roll of pressure sensitive tape is mounted between two adjacent divider walls. The free end of the roll is positioned such that the pressure sensitive tape passes over the bar means and the release film passes under the bar means. Accordingly, the separating of the pressure sensitive tape from the release film is readily accomplished and the tape is always in position for rapid use.

BRIEF DESCRIPTION OF THE DRAWINGS

The objects and advantages of the instant invention will become apparent when the specification is read in conjunction with the drawings, wherein.

DESCRIPTION OF THE PREFERRED EMBODIMENTS

The present invention relates to a tape dispenser, having a top and bottom wall, a back wall, two side walls and a partial front wall. Grooves in the top and bottom walls hold dividers in place and a bar, held by brackets, keeps the ends of the pressure sensitive tape clean and properly placed.

The material to be dispensed in the instant invention is a plastic based material having a removable plastic coating on the top side and a paper coating on the bottom side. The material is machine rolled tightly onto the core of the roll providing a certain amount of stability. The material will not slide off the core, however the core can be forcibly removed and the material distorted into a funnel shape. The components of the pressure sensitive tape provide it with a limited "body" to hold shape; the top and back coverings provide some degree of resistance to unrolling.

Figure 1:
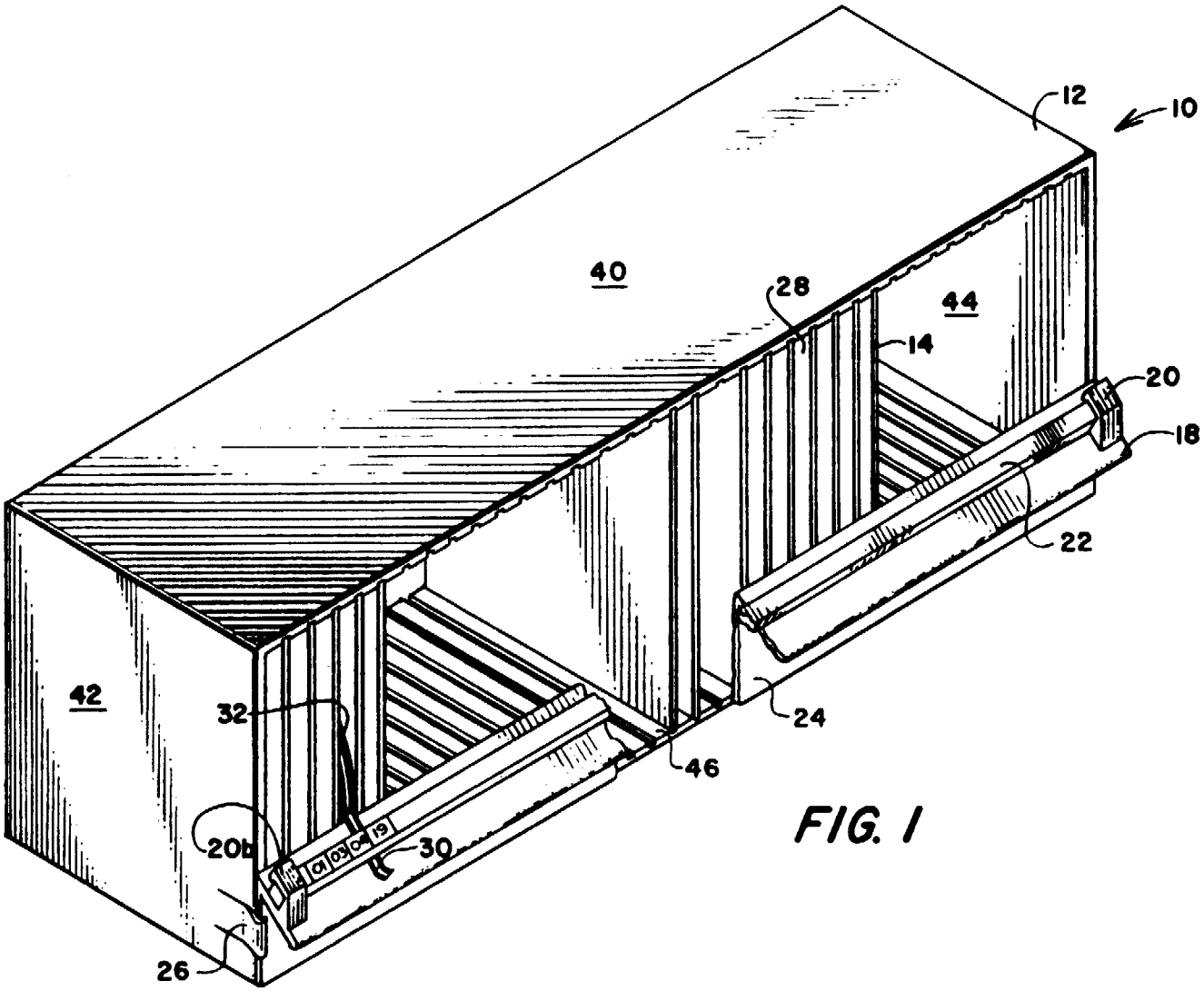
FIG. 1 is a cutaway perspective view of the disclosed tape dispenser.

The tape dispenser 10 is shown in FIG. 1 with part of the front wall 24, lip 18 and securing bar 22 cut away. The tape dispenser 10 has a partial front wall 24 runs the length of the tape dispenser 10, covering only the lower portion of the front of the tape dispenser 10. The partial front wall 24 prevents the tape rolls 32 from rolling out of the tape dispenser 10. The partial front wall 24 is attached to the bottom wall 46 through the hinge 50, of FIG. 2, and held in place by molded spring clips 26. The preferred hinge 50 would be the living hinge as known in the prior art, such as U.S. Pat. No. 2,004,320 to Hanson and U.S. Pat. No. 2,609,920 to Ringler. The spring clip 26 as illustrated herein is the preferred embodiment, however other means, as known in the prior art, can be used to secure the partial front wall 24 to the side walls 42 and 44, The partial front wall 24 is released and allowed to swing outward to insert the rolls of tape into the slots 28.

The partial front wall 24 has a lip 18 which extends at an angle from the top edge of the partial front wall 24 and provides a place to secure the tape ends 30. The angle of the lip 18 can be determined by manufacture, however, for convenience and ease of viewing, it is recommended that the lip 18 be at less than a 90 degree angle from the partial front wall 24. The securing bar 22 prevents the tape ends 30 from lifting off the lip 18, as well as providing a place to indicate codes, colors, etc. The securing bar 22 is held to the lip 18 by brackets **20*a* and 20*b* and can be removed from the brackets 20*a* and 20*b*, by either sliding through the ends of the brackets 20*a* and 20*b* or lifting upward through the open spaces of the brackets 20*a* and 20*b*. The securing bar must be dimensioned to be placed into and removed from the brackets 20*a* and 20*b* without tearing the tape ends 30**.

Figure 3:
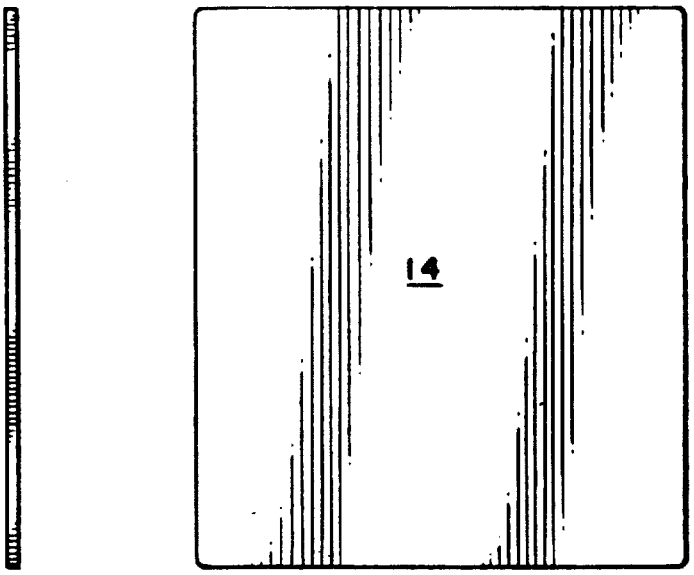
FIG. 3 is a side view of the dividers of the instant disclosure.

The top wall 40 and the bottom wall 46 are grooved with slots 12 and 16. The slots 12 in the top wall 40 and slots 16 in the bottom wall 46 must be aligned to allow the dividers 28 to be slid in parallel to the side walls 44 and 42 and to one another. The dividers 28, as shown in FIG. 3, are dimensioned to friction fit into the tape dispenser 10 slots 12 and 16.

Figure 2:
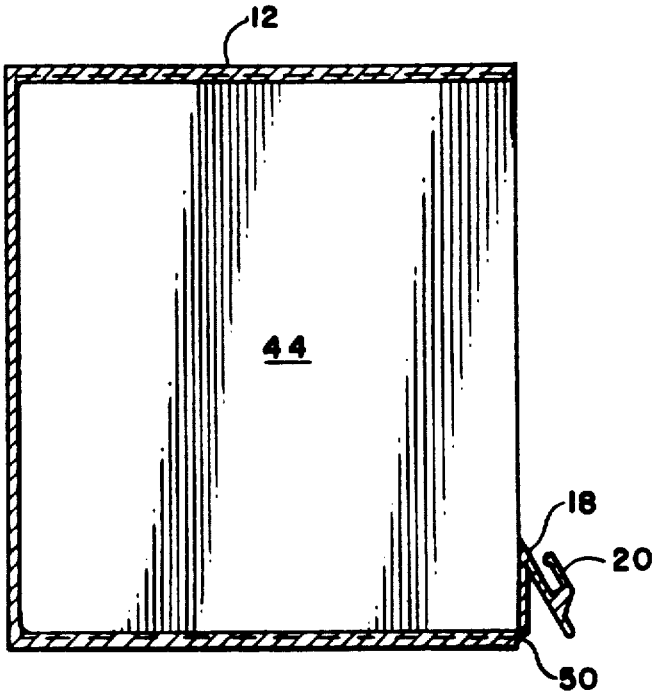
FIG. 2 is a side view of the tape dispenser of FIG. 1.

A side view of the brackets 20 and lip 18 are shown in FIG. 2. The bracket 20, as shown herein, represent only one shape of many shapes which can be used and is not intended to limit the disclosure to a single configuration. The hinge 50 is formed by decreasing the amount of material at that point, through compression or other means and causing the construction material to bend along that line. The formation of a hinged corner is made thereat.

The preferred material of manufacture for the tape dispenser 10 is any of the plastics. Aluminum, or the like, can also be used, although it is not as economical. Wood can be used for the construction and the hinge 50 of FIG. 2 replaced with a conventional mechanical hinge.

What is claimed is:

1. A tape dispenser, said tape dispenser comprising a container, said container having:

a top wall, wherein said top wall further comprises a plurality of grooves equidistant from one another;

a bottom wall, wherein said bottom wall further comprises a plurality of grooves equidistant from one another, said top wall grooves and said bottom wall grooves being position to correspond with one another;

a back wall, a first side wall;

a second side wall;

a partial front wall, said partial front wall being movably affixed to said bottom wall and further comprising a lip, said lip being at an angle to said partial front wall;

dividers, said dividers being slideably retained in said grooves and being parallel to said first side wall and said second side wall;

clamping means, said clamping means being on said first side wall and said second side wall proximate said partial front wall, thereby removably securing said partial front wall to said first side wall and said second side wall.

2. The tape dispenser of claim 1 wherein said lip has holding means affixed proximately the ends of said lip.

3. The tape dispenser of claim 2 wherein said lip further comprises bar means, said bar means being held in contact with said lip by said holding means.

4. A dispenser apparatus for a pressure sensitive tape, wherein said pressure sensitive tape is mounted on a release film to form a two layer unit, said two layer unit being in the form of a spiral roll of tape, said tape dispenser comprising:

container means, said container means having a first side wall, a second side wall, a top wall, said top wall having a plurality of top wall parallel grooves, a bottom wall, said bottom wall having a plurality of bottom wall parallel grooves, said top wall parallel groove being positioned so as to correspond to the position of said top wall parallel grooves, said top wall grooves and said bottom wall grooves being parallel to said first side wall and said second side wall a plurality of divider walls, each of said divider walls having a first edge slidably retained in one of said top wall parallel groove and a second edge slidably retained in a bottom wall parallel groove, said bottom wall parallel groove being positioned opposite said top wall parallel groove, a back wall, a front wall, said front wall having vertical dimension substantially less than the corresponding vertical dimension of said back wall, thereby forming a substantial rectangular opening, said front wall being hingedly affixed to said container bottom wall, said front wall having a lip member, said lip member forming an acute angle with said front wall, holding means, said holding means being proximate two opposite ends of said lip member, bar means, said bar means being held in a spaced relationship with said lip member by said holding means.

5. The tape dispenser of claim 4 wherein said front wall is hingedly affixed to said bottom wall by means of a self hinge.

6. The tape dispenser of claim 4 wherein said first side wall and said second side wall have clamping means proximate said partial front wall, thereby releasably securing said partial front wall to said first side wall and said second side wall.

7. The tape dispenser of claim 4, further comprising a plurality of rolls of pressure sensitive tape are contained within said container, and wherein each roll of pressure sensitive tape is mounted between two adjacent divider walls, with the free end of said roll being positioned such that the pressure sensitive tape passes over said bar means and said release film passes under said bar means, thereby separating said pressure sensitive tape from said release film.

* * * * *